US008573304B2

(12) United States Patent
Vick, Jr. et al.

(10) Patent No.: US 8,573,304 B2
(45) Date of Patent: Nov. 5, 2013

(54) ECCENTRIC SAFETY VALVE

(75) Inventors: James D. Vick, Jr., Dallas, TX (US); Jimmie R. Williamson, Jr., Carrollton, TX (US); Bruce E. Scott, McKinney, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 344 days.

(21) Appl. No.: 12/951,502

(22) Filed: Nov. 22, 2010

(65) Prior Publication Data

US 2012/0125597 A1 May 24, 2012

(51) Int. Cl.
*E21B 34/06* (2006.01)

(52) U.S. Cl.
USPC ..... 166/321; 166/332.8; 166/334.1

(58) Field of Classification Search
USPC ..... 166/319, 321, 332.8, 334.1
See application file for complete search history.

(56) References Cited

U.S. PATENT DOCUMENTS

| | | | | |
|---|---|---|---|---|
| 3,196,948 | A | 7/1965 | Dye | |
| 3,666,030 | A | 5/1972 | Bohn et al. | |
| 3,731,742 | A | 5/1973 | Sizer et al. | |
| 4,058,166 | A | 11/1977 | Crickmer | |
| 4,191,248 | A | 3/1980 | Huebsch et al. | |
| 4,407,329 | A | 10/1983 | Huebsch et al. | |
| 4,467,870 | A | 8/1984 | Langham | |
| 4,540,047 | A * | 9/1985 | Akkerman | 166/188 |
| 4,579,177 | A | 4/1986 | Going, III | |
| 4,619,323 | A | 10/1986 | Gidley | |
| 4,624,443 | A | 11/1986 | Eidsmore | |
| 4,649,993 | A | 3/1987 | Going, III | |
| 4,667,736 | A | 5/1987 | Rumbaugh et al. | |
| 4,725,783 | A | 2/1988 | Miyairi et al. | |
| 4,732,225 | A | 3/1988 | Jurgens et al. | |
| 4,796,708 | A | 1/1989 | Lembcke | |
| 4,798,247 | A | 1/1989 | Deaton et al. | |
| 4,886,114 | A | 12/1989 | Perkins et al. | |
| 4,940,207 | A | 7/1990 | Katsuyama | |
| 4,981,173 | A | 1/1991 | Perkins et al. | |
| 5,070,595 | A | 12/1991 | Perkins et al. | |
| 5,070,944 | A | 12/1991 | Hopper | |

(Continued)

FOREIGN PATENT DOCUMENTS

| | | | |
|---|---|---|---|
| DE | 4214848 | A1 | 11/1993 |
| EP | 436214 | B1 | 2/1996 |

(Continued)

OTHER PUBLICATIONS

International Search Report issued Jul. 1, 2008, for International Patent Application No. PCT/US2007/088924, 2 pages.

(Continued)

*Primary Examiner* — William P Neuder
(74) *Attorney, Agent, or Firm* — Smith IP Services, P.C.

(57) ABSTRACT

A safety valve for use in a subterranean well can include a housing assembly having a flow passage extending longitudinally through the housing assembly. An outer diameter of the housing assembly is eccentric relative to the flow passage. A well tool can include a magnetic coupling between magnet devices. One magnet device includes a series of magnets which are unequally spaced circumferentially about the other magnet device. Another safety valve can include a longitudinally extending flow passage, a closure device which selectively permits and prevents flow through the flow passage, and an outer diameter which is eccentric relative to the flow passage.

15 Claims, 10 Drawing Sheets

(56) References Cited

U.S. PATENT DOCUMENTS

| | | | | |
|---|---|---|---|---|
| 5,257,663 | A | 11/1993 | Pringle et al. | |
| 5,291,947 | A | 3/1994 | Stracke | |
| 5,293,551 | A | 3/1994 | Perkins et al. | |
| 5,299,640 | A | 4/1994 | Streich et al. | |
| 5,310,012 | A | 5/1994 | Cendre et al. | |
| 5,409,031 | A | 4/1995 | McGill et al. | |
| 5,558,153 | A | 9/1996 | Holcombe et al. | |
| 5,620,048 | A | 4/1997 | Beauquin | |
| 5,734,209 | A | 3/1998 | Hallidy | |
| 5,913,337 | A | 6/1999 | Williams et al. | |
| 5,917,774 | A | 6/1999 | Walkow et al. | |
| 5,954,135 | A | 9/1999 | Williamson et al. | |
| 6,016,845 | A | 1/2000 | Quigley et al. | |
| 6,041,857 | A | 3/2000 | Carmody et al. | |
| 6,112,809 | A | 9/2000 | Angle | |
| 6,237,693 | B1 | 5/2001 | Deaton | |
| 6,253,843 | B1 | 7/2001 | Rawson et al. | |
| 6,302,210 | B1 | 10/2001 | Crow et al. | |
| 6,310,829 | B1 | 10/2001 | Green et al. | |
| 6,315,047 | B1 * | 11/2001 | Deaton et al. | 166/319 |
| 6,321,845 | B1 | 11/2001 | Deaton | |
| 6,352,118 | B1 | 3/2002 | Dickson et al. | |
| 6,361,299 | B1 | 3/2002 | Quigley et al. | |
| 6,433,991 | B1 | 8/2002 | Deaton et al. | |
| 6,478,090 | B2 | 11/2002 | Deaton | |
| 6,491,106 | B1 | 12/2002 | Simonds | |
| 6,561,278 | B2 | 5/2003 | Restarick et al. | |
| 6,568,470 | B2 | 5/2003 | Goodson, Jr. et al. | |
| 6,619,388 | B2 | 9/2003 | Dietz et al. | |
| 6,626,244 | B2 | 9/2003 | Powers | |
| 6,748,977 | B2 | 6/2004 | Berto | |
| 6,863,124 | B2 | 3/2005 | Araux et al. | |
| 6,988,556 | B2 | 1/2006 | Vick, Jr. | |
| 7,059,194 | B1 | 6/2006 | Lueck et al. | |
| 7,434,626 | B2 * | 10/2008 | Vick, Jr. | 166/373 |
| 7,487,829 | B2 | 2/2009 | McDonald et al. | |
| 7,597,149 | B2 * | 10/2009 | Williamson et al. | 166/332.8 |
| 7,644,767 | B2 | 1/2010 | Kalb et al. | |
| 8,002,040 | B2 * | 8/2011 | May et al. | 166/332.8 |
| 8,038,120 | B2 | 10/2011 | Vick, Jr. et al. | |
| 8,151,889 | B2 * | 4/2012 | Biddick | 166/332.8 |
| 2002/0023759 | A1 | 2/2002 | Deaton | |
| 2002/0108747 | A1 | 8/2002 | Dietz et al. | |
| 2002/0112861 | A1 | 8/2002 | Restarick et al. | |
| 2003/0015319 | A1 | 1/2003 | Green et al. | |
| 2003/0019622 | A1 | 1/2003 | Goodson, Jr. et al. | |
| 2003/0047317 | A1 | 3/2003 | Powers | |
| 2003/0132003 | A1 | 7/2003 | Arauz et al. | |
| 2003/0155131 | A1 | 8/2003 | Vick, Jr. | |
| 2003/0192687 | A1 | 10/2003 | Goodson, Jr. et al. | |
| 2005/0077050 | A1 | 4/2005 | MacKay et al. | |
| 2005/0087335 | A1 | 4/2005 | Vick, Jr. | |
| 2006/0043972 | A1 | 3/2006 | Williamson, Jr. | |
| 2007/0289734 | A1 | 12/2007 | McDonald et al. | |
| 2008/0157014 | A1 | 7/2008 | Vick, Jr. et al. | |
| 2011/0088907 | A1 | 4/2011 | Xu | |
| 2012/0032099 | A1 | 2/2012 | Vick, Jr. | |

FOREIGN PATENT DOCUMENTS

| | | | |
|---|---|---|---|
| EP | 9977676 | A2 | 5/2000 |
| FR | 2480360 | A1 | 10/1981 |
| FR | 2509804 | A1 | 1/1983 |
| GB | 2186667 | A | 8/1987 |
| GB | 2200775 | A | 8/1988 |
| GB | 2241302 | A | 8/1991 |
| GB | 2362407 | A | 11/2001 |
| GB | 2379562 | A | 3/2003 |
| GB | 2390750 | A | 1/2004 |
| JP | 11093883 | A | 4/1999 |
| WO | W00053890 | A1 | 9/2000 |

OTHER PUBLICATIONS

Written Opinion issued Jul. 1, 2008, for International Patent Application No. PCT/US2007/088924, 4 pages.

Office Action issued Feb. 4, 2011, for U.S. Appl. No. 11/618,489, 18 pages.

International Search Report with Written Opinion issued Jun. 29, 2012 for PCT Patent Application No. PCT/US11/060418, 11 pages.

Dexter, Magnetic Technologies, "Magnetically Geared and Sprung Safety Valve," undated, 1 page.

Lester R. Moskowitz, Permanent Magnet Design and Application Handbook, 2nd Edition, p. 9 & 21, dated 1995, 3 pages.

Halliburton, Completion Products Catalog, pp. 4-6 & 4-7, dated 1996, 4 pages.

Festo, Pneumatic Products Catalog, 2nd Edition, p. 1.292, Double-Acting Rodless Cylinder Type DGO-. . . PPV-A, dated 1986, 3 pages.

Examination report issued Jan. 19, 2005, for GB Patent Application No. 0303480.8, 3 pages.

Combined Search and Examination Report issued Nov. 21, 2005, for UK Patent Application No. GB 0518146.6, 2 pages.

Office Action issued Aug. 22, 2003, for U.S. Appl. No. 10/078,839, 7 pages.

Office Action issued Jan. 21, 2004, for U.S. Appl. No. 10/078,839, 9 pages.

Office Action issued Jun. 10, 2004, for U.S. Appl. No. 10/078,839, 15 pages.

Office Action issued Sep. 17, 2004, for U.S. Appl. No. 10/078,839, 15 pages.

Office Action issued May 12, 2005, for U.S. Appl. No. 10/078,839, 9 pages.

Office Action issued Dec. 2, 2005, for U.S. Appl. No. 11/194,197, 18 pages.

Office Action issued Mar. 23, 2006, for U.S. Appl. No. 10/990,748, 9 pages.

Office Action issued May 9, 2006, for U.S. Appl. No. 10/194,197, 7 pages.

Office Action issued Sep. 8, 2005, for U.S. Appl. No. 10/990,748, 6 pages.

Office Action issued Oct. 26, 2005 for U.S. Appl. No. 10/990,748, 18 pages.

Office Action issued Apr. 30, 2007, for U.S. Appl. No. 11/471,053, 15 pages.

Office Action issued Aug. 21, 2006, for U.S. Appl. No. 10/990,748, 6 pages.

Office Action issued Apr. 15, 2005, for U.S. Appl. No. 10/990,748, 13 pages.

International Search Report and Written Opinion issued Feb. 28, 2013 for PCT Application No. PCT/US2012/051983, 10 pages.

* cited by examiner

ECCENTRIC SAFETY VALVE

BACKGROUND

This disclosure relates generally to equipment utilized and operations performed in conjunction with a subterranean well and, in an example described below, more particularly provides an eccentric safety valve.

It is frequently desirable to install lines (e.g., optical, electrical, fluid, etc., lines) alongside well tools in wellbores. Unfortunately, wellbores are very confined spaces, and so it has been common practice to reduce the outer diameter of a well tool, in order to accommodate the presence of one or more lines positioned next to the well tool. However, by reducing the diameter of the well tool, the functionality of the well tool (e.g., flow area through the well tool, actuator effectiveness, etc.) is usually adversely affected.

Therefore, it will be appreciated that improvements are needed in the art. Such improvements would preferably allow for the presence of one or more lines alongside a well tool, without significantly affecting the functionality of the well tool.

SUMMARY

In the disclosure below, a well tool is provided which brings improvements to the art of accommodating lines in wellbores. One example is described below in which a safety valve has longitudinal grooves formed in its outer surface. Another example is described below in which an outer diameter of a well tool is eccentric relative to an inner diameter of the well tool.

In one aspect, a safety valve for use in a subterranean well can include a housing assembly having a flow passage extending longitudinally through the housing assembly. An outer diameter of the housing assembly is eccentric relative to the flow passage.

In another aspect, a well tool can include a magnetic coupling between magnet devices. One magnet device includes a series of magnets which are unequally spaced circumferentially about the other magnet device.

In yet another aspect, a safety valve can include a longitudinally extending flow passage, a closure device which selectively permits and prevents flow through the flow passage and an outer diameter which is eccentric relative to the flow passage.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
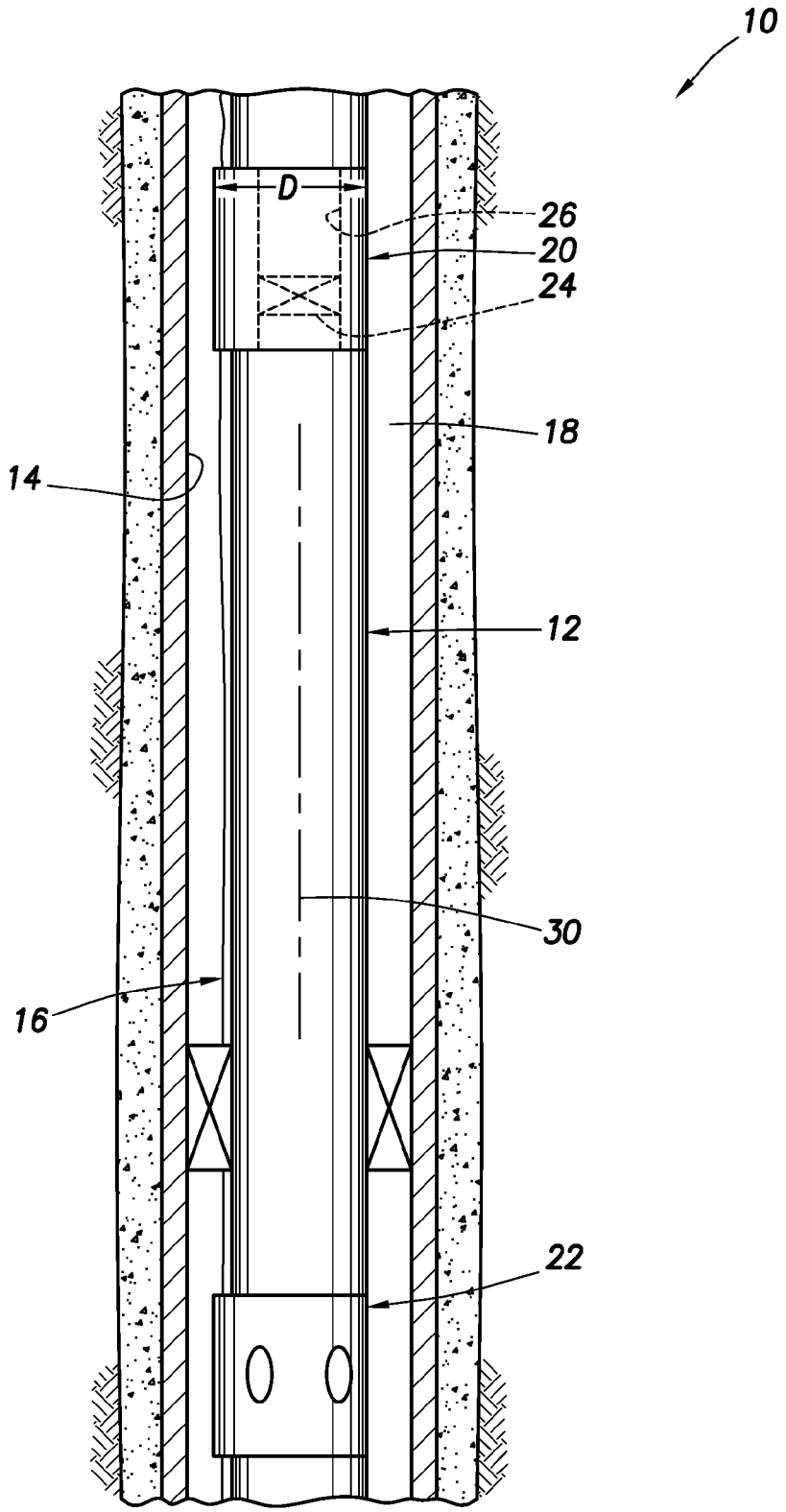
FIG. 1 is a schematic partially cross-sectional view of a well system and associated method which can embody principles of the present disclosure.
Figure 2A:
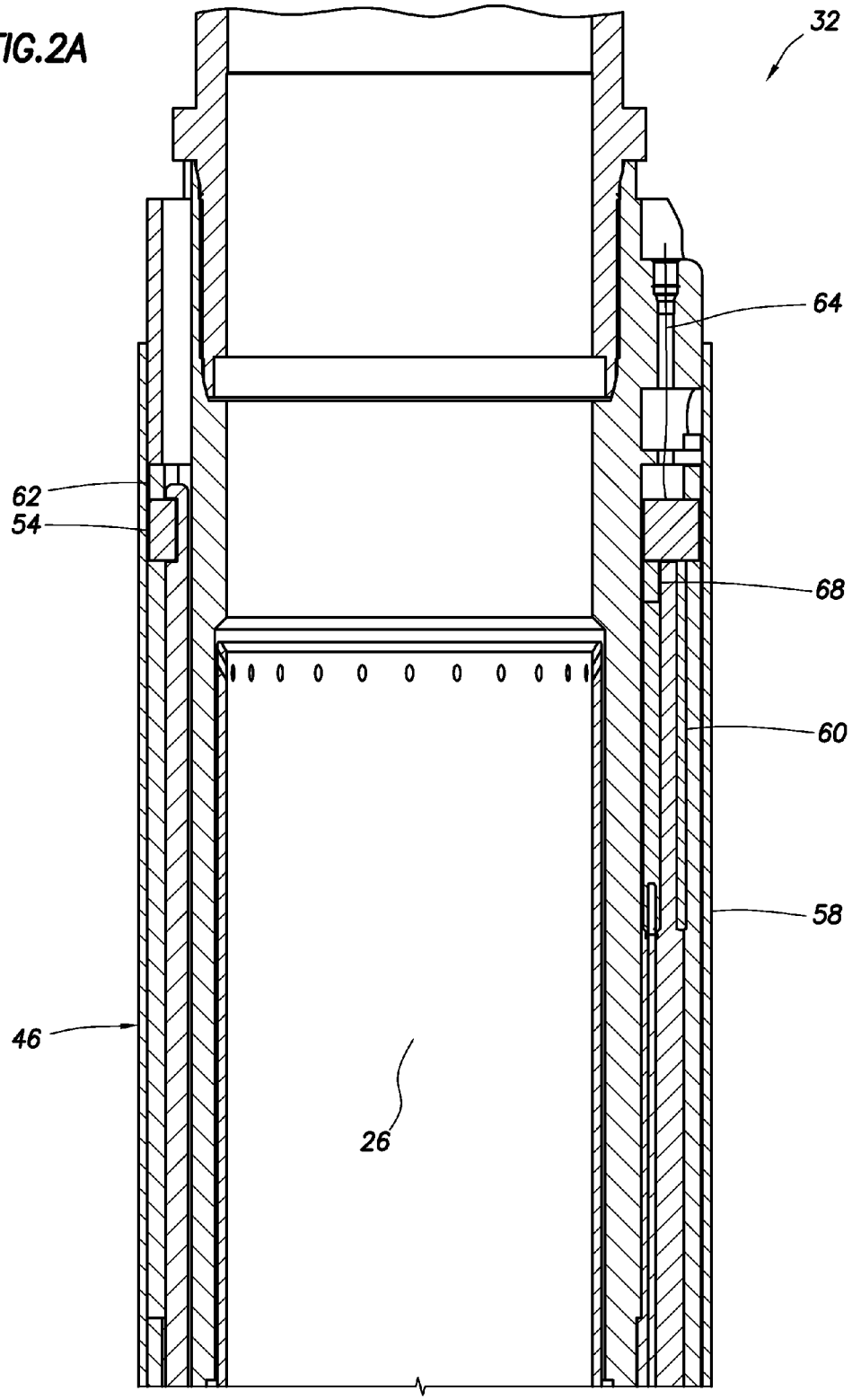
FIGS. 2A-E are enlarged scale schematic cross-sectional views of a safety valve which may be used in the well system of FIG. 1.
Figure 2B:
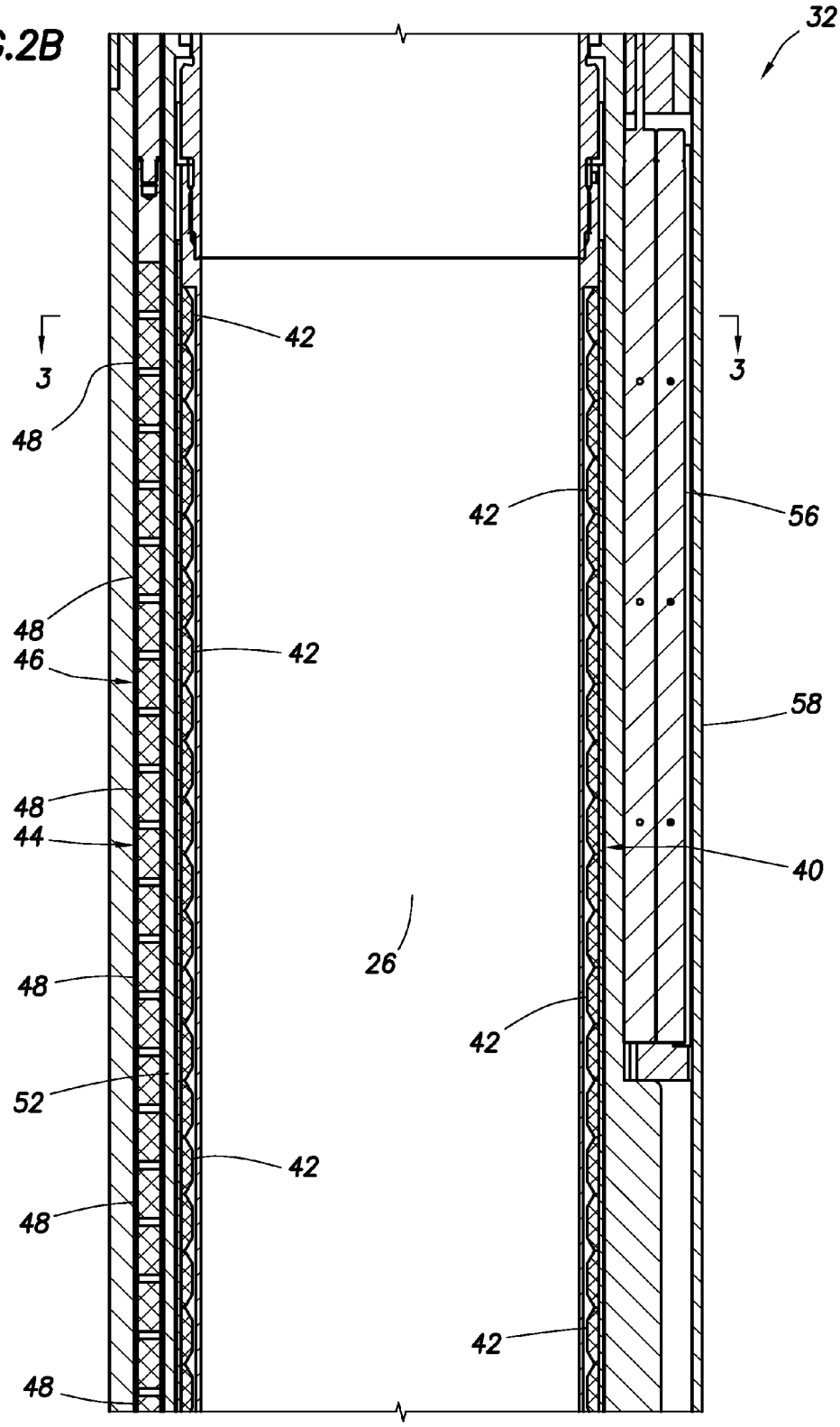
Figure 2C:
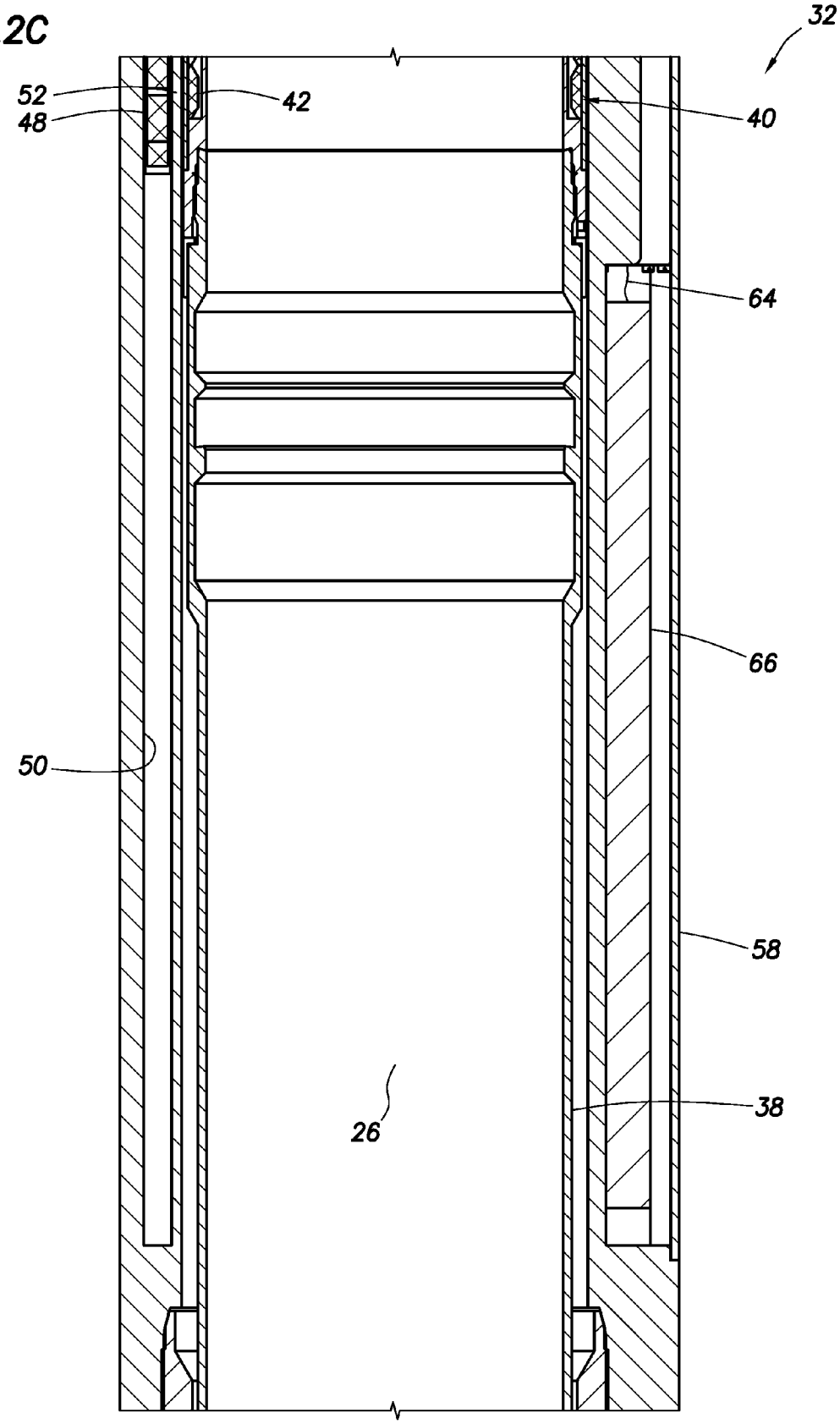
Figure 2D:
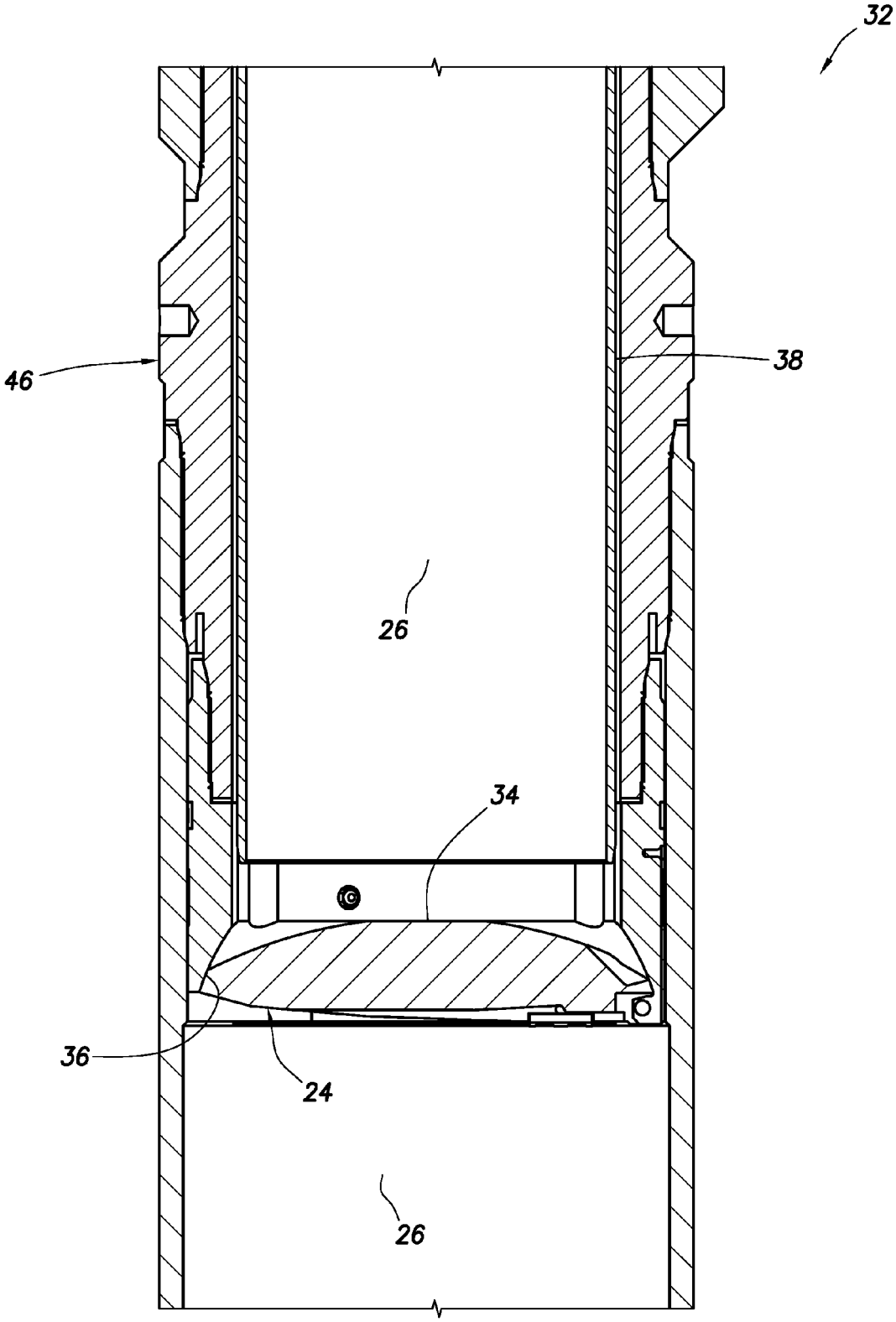
Figure 2E:
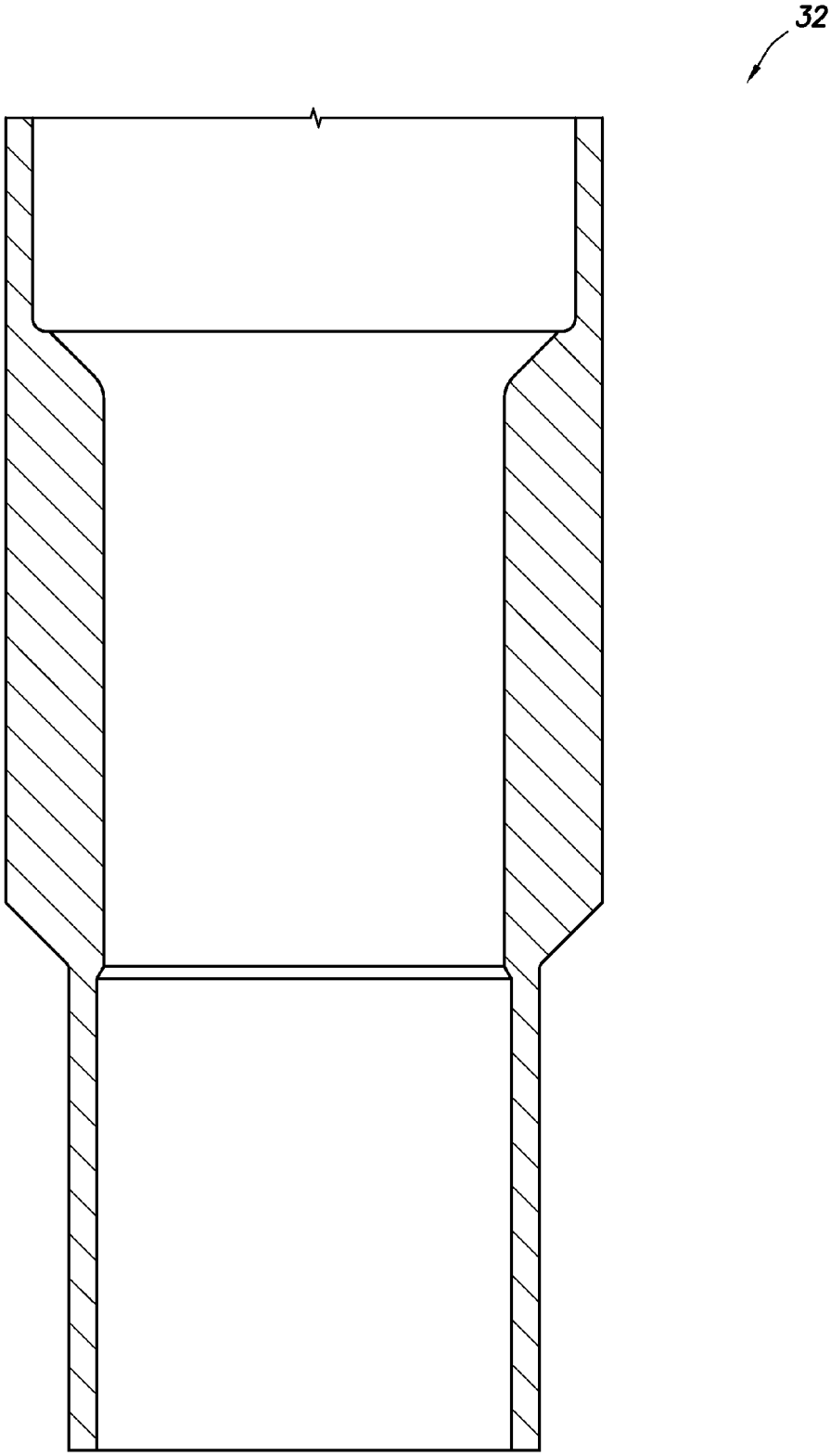

Representatively illustrated in FIG. 1 is a well system 10 and associated method which can embody principles of this disclosure. In the well system 10, a tubular string 12 is installed in a wellbore 14. All or part of the wellbore 14 could be cased and cemented as depicted in FIG. 1, or the wellbore could be uncased at the location of the tubular string 12.

One or more lines 16 extends longitudinally along the tubular string 12. The lines 16 could be electrical, optical, fluid (such as, hydraulic or pneumatic), communication, data, power, control, or any other types of lines.

The lines 16 can be positioned external to the tubular string 12, in an annulus 18 formed radially between the tubular string and the wellbore 14. The lines 16 are also external to well tools 20, 22 interconnected in the tubular string 12. The well tools 20, 22 are depicted as a safety valve and a production valve, respectively, but it should be clearly understood that the principles of this disclosure can be utilized with any type of well tool.

The well tool 20 includes a closure device 24 which selectively permits and prevents flow through a flow passage 26 extending longitudinally through the well tool. Note that the well tool 20 is eccentric relative to most of the tubular string 12 (e.g., an outer diameter D of the well tool is laterally offset relative to a longitudinal axis 30 of the flow passage 26 in the well tool and the remainder of the tubular string 12).

Although the annulus 18 as depicted in FIG. 1 is able to easily accommodate the presence of the lines 16 adjacent the well tools 20, 22 and the remainder of the tubular string 12, in other examples the annulus could be very small, in which case the outer diameters of the well tools may have to be reduced in order to accommodate the lines. This reduction in outer diameter can compromise the functionality of the well tools 20, 22, if not for the advantages which can be obtained by use of the principles of this disclosure.

Referring additionally now to FIGS. 2A-E, an enlarged scale cross-sectional view of a safety valve 32 which may be used for the well tool 20 in the system 10 of FIG. 1 is representatively illustrated. The safety valve 32 is of the type which can close off flow through the flow passage 26 of the tubular string 12 (and thereby prevent unwanted release of fluid from a well), in response to an emergency situation.

For this purpose, the safety valve 32 includes the closure device 24 which can close off flow through the passage 26. A flapper 34 of the closure device 24 seals against a seat 36 to prevent flow through the passage 26.

In other examples, a ball could rotate to selectively permit and prevent flow through the passage 26, etc. Thus, it should be clearly understood that it is not necessary for a safety valve incorporating the principles of this disclosure to have all of the details of the safety valve 32 depicted in FIGS. 2A-E. Instead, the principles of this disclosure could be applied to any type of safety valve, and to any other types of well tools (such as the well tool 22 depicted in FIG. 1).

The flapper 34 is displaced from its closed position (shown in FIG. 2D) to an open position by downward displacement of an operating member 38. The operating member 38 depicted in FIGS. 2C & D is in the form of a flow tube or opening prong encircling the passage 26. When the operating member 38 displaces downward, it contacts the flapper 34, pivoting the flapper downward and away from the seat 36, thereby permitting flow through the passage 26.

The operating member 38 is displaced downward by a magnetic force exerted upon a magnet device 40 attached to the operating member. The magnet device 40 comprises a longitudinal stack of multiple annular magnets 42. The magnets 42 are concentric relative to the flow passage 26.

Another magnet device 44 is located in a housing assembly 46 which pressure isolates the flow passage 26 from the annulus 18. Although only one is visible in FIGS. 2B & C, the magnet device 44 includes multiple longitudinal stacks of magnets 48 positioned in longitudinally extending openings 50 distributed circumferentially about the magnet device 40.

In one unique aspect of the safety valve 32, the magnets 48 are not uniformly distributed about the magnets 42. Instead, the circumferential spacings between the magnets 48 can vary, to thereby allow room for other components, as described more fully below.

There is a magnetic coupling 52 between the magnet devices 40, 44 which forces the magnet devices to displace longitudinally with each other. Thus, to cause downward displacement of the operating member 38, the magnet device 44 is displaced downward to thereby cause downward displacement of the magnet device 40 via the magnetic coupling 52.

The magnet device 44 is displaced downward by downward displacement of a ring 54 to which the magnets 48 are attached. The ring 54 is displaced downward by at least one motor 56, two of which are preferably included for redundancy. In this example, the motors 56 are electric stepper motors, but other types of motors, and other types of actuators, may be used in keeping with the principles of this disclosure.

A shroud 58 protects the motors 56 and other electrical components from exposure to fluids and pressures in the annulus 18. The shroud 58 is preferably welded to the remainder of the housing assembly 46, with weld joints which are not subjected to high stresses caused by compression and elongation of the tubular string 12.

A displacement sensor 60 (such as a potentiometer, etc.) may be used to sense displacement of the ring 54 and, thus, of the operating member 38. A position sensor 62 (such as a limit switch, proximity sensor, etc.) may be used to sense when the ring 54 has displaced to a particular position (such as, to a position in which the operating member 38 has pivoted the flapper 34 out of sealing contact with the seat 36, etc.). A force sensor 68 (such as a piezoelectric sensor, etc.) may be used to measure how much force is applied to the ring 54 by the motor 56.

Power, data, and command and control signals can be connected to the safety valve 32 via lines 64 extending through the housing assembly 46. The lines 64 preferably connect to a control system 66 which controls operation of the motor 56. The sensors 60, 62, 68 are also connected to the control system 66, as described more fully below.

Figure 3:
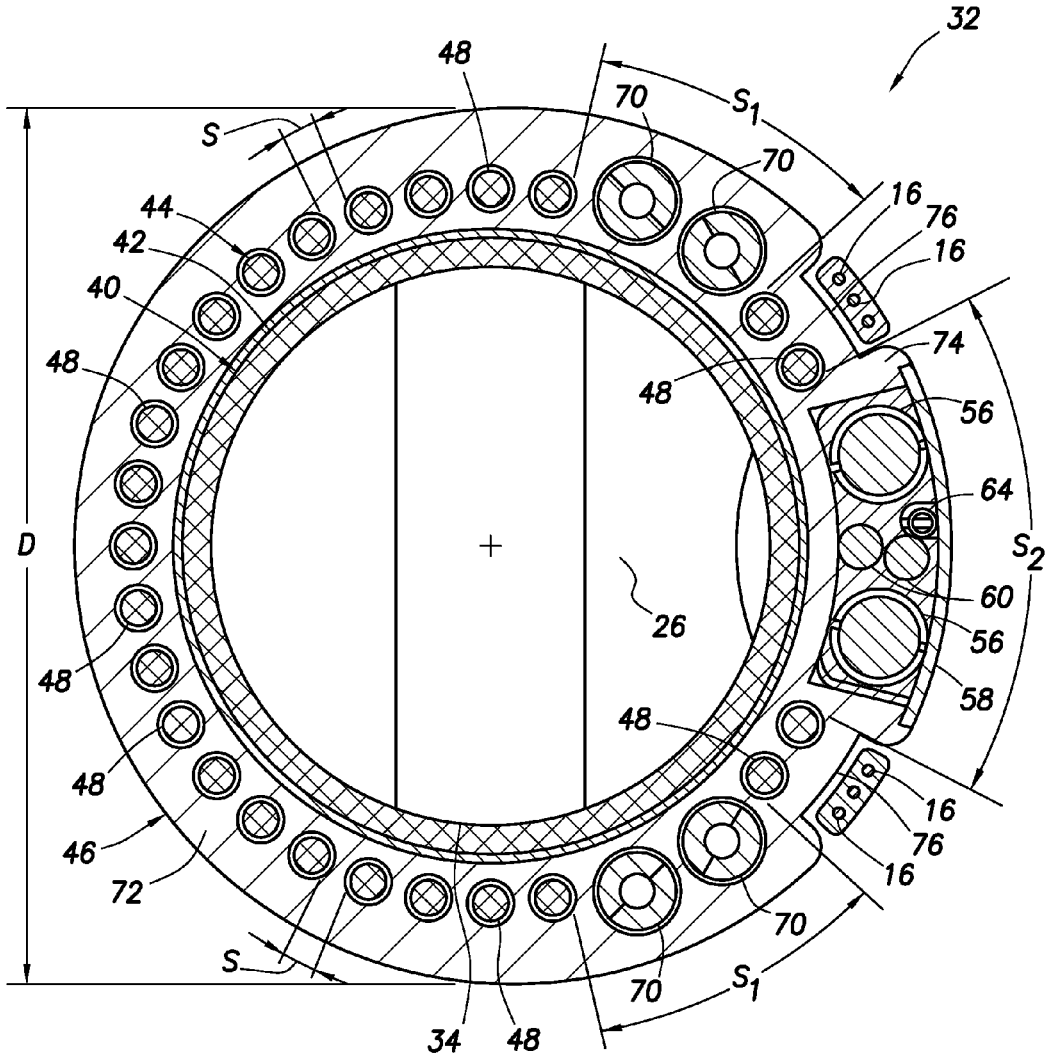
FIG. 3 is a schematic cross-sectional view of the safety valve, taken along line 3-3 of FIG. 2B.

Referring additionally now to FIG. 3, a cross-sectional view of the safety valve 32, taken along line 3-3 of FIG. 2_, is representatively illustrated. In this view, the manner in which the magnets 48 are unevenly spaced circumferentially about the magnets 42 can be clearly seen.

Most of the magnets 48 are spaced apart from adjacent magnets by a spacing s which is less than a spacing S1 between two pairs of the magnets, and which is much less than another spacing S2 between another pair of the magnets. The increased spacing S1 is provided to accommodate biasing devices 70 (such as compression springs, etc.) between the magnets 48, and the increased spacing S2 is provided to accommodate the lines 64 between the magnets.

The biasing devices 70 apply an increasing biasing force to the ring 54 as it displaces downward. Thus, the motor 56 must overcome the biasing force exerted by the biasing devices 70 in order to displace the ring 54 downward. The biasing force is used to displace the ring 54 upward and thereby close the flapper 34, in order to prevent flow through the passage 26.

Note that a sidewall 72 of the housing assembly 46 is thicker on one side (wall section 74) as compared to an opposite side. This is due to the fact that an outer diameter D of the housing assembly 46 is eccentric relative to the flow passage 26.

The thickened wall section 74 provides space for accommodating the biasing devices 70 and lines 16, 64. The lines 16 are positioned in grooves or recesses 76 which extend longitudinally along the exterior of the housing assembly 46.

Figure 4A:
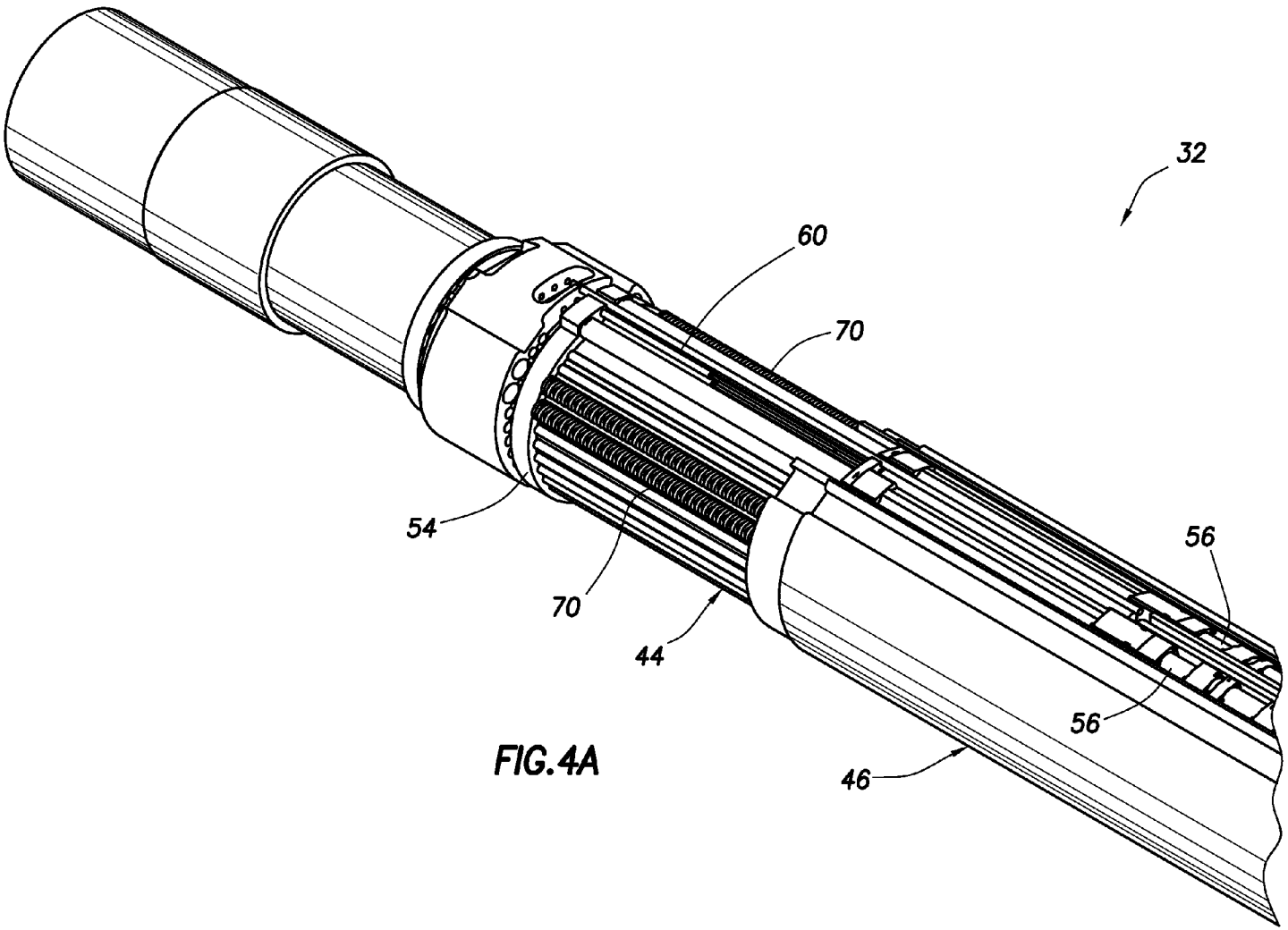
FIGS. 4A & B are schematic isometric views of the safety valve.
Figure 4B:
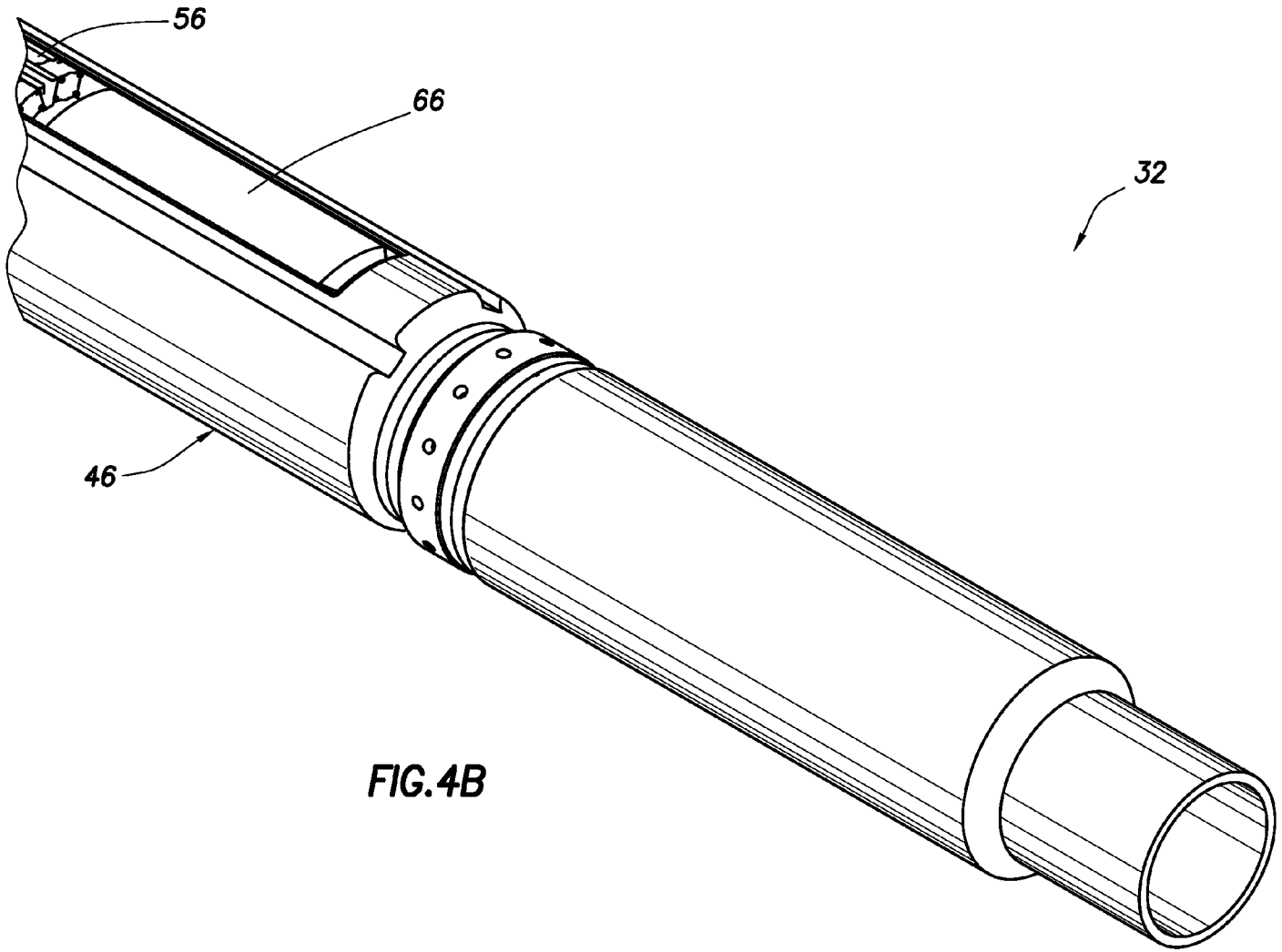

Referring additionally now to FIGS. 4A & B, the safety valve 32 is representatively illustrated with the shroud 58 removed. Note how the thickened wall section 74 accommodates the biasing devices 70, potentiometers 60, motors 56 and control system 66. Some of the magnets 48 are also positioned in the thickened wall section 74.

Because the magnets 48 are not evenly circumferentially distributed about the magnets 42, the magnetic coupling 52 between the magnet devices 40, 44 will be stronger on one side of the safety valve 32, as compared to on an opposite side of the safety valve. For this reason, the magnet device 44 will be pulled more to the strong side of the magnetic coupling 52, and so friction reducing devices (such as those described in U.S. Pat. No. 7,644,767) may be used in the safety valve 32 to reduce any friction due to this force imbalance.

Figure 5:
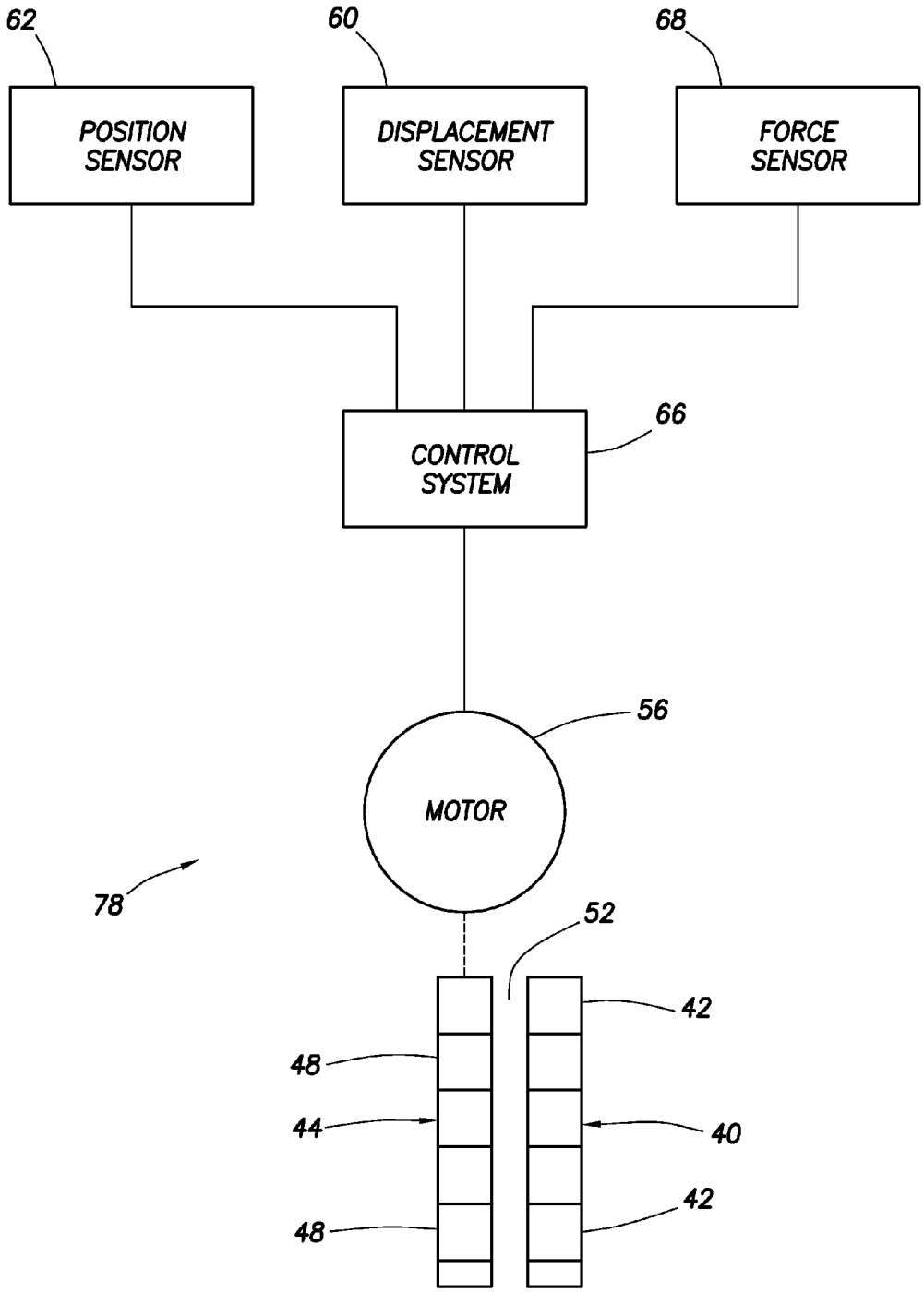
FIG. 5 is a schematic diagram of a motor control system for the safety valve.

Referring additionally now to FIG. 5, a motor control system 78 which can be used to control operation of the motor 56 is schematically illustrated. The motor control system 78 includes the control system 66 which is connected to the motor 56, and to each of the sensors 60, 62, 68.

The motor 56 can be uniquely controlled in a manner which can prevent excessive force being applied across the magnetic coupling 52, for example, when the flapper 34 is being opened against a pressure differential in the passage 26. If excessive force is applied across the magnetic coupling 52 when displacing the magnet device 40 to displace the operating member 38, the magnets 42, 48 can "slip" relative to one another, allowing relative displacement between the magnet devices 40, 44. This situation should preferably be avoided.

In one example, excessive force is prevented by limiting a rate at which electrical pulses are transmitted from the control system 66 to the motor 56. If the force generated by the motor 56 is insufficient to displace the ring 54 and the magnet device 44 at such a limited pulse rate, the motor can "dither" in place until the reason for the need for increased force is removed (e.g., until the pressure differential in the flow passage 26 is relieved).

In another example, the control system 66 can include a control algorithm which prevents decoupling between the magnet devices 40, 44 by intelligently limiting the electrical pulse rate supplied to the motor 56 based on stall determination (as sensed by sensors 60, 62 and/or 68), counting a number of steps of the motor, providing for a certain timing between attempts to displace the ring 54, resetting a step count when the motor displaces the ring to a certain position, permitting an increased pulse rate when less force is needed (such as, when the sensors 60, 62, 68 indicate that the operating member has opened the flapper), etc.

It may now be fully appreciated that the well system 10 and safety valve 32 described above provide several advancements to the art of accommodating lines 16 in the wellbore 14. The longitudinal recesses 76 accommodate the lines 16 in the thickened wall section 74, which is due to the outer diameter D of the housing assembly 46 being eccentric relative to the flow passage 26.

In particular, the above disclosure provides to the art a safety valve 32 for use in a subterranean well. The safety valve 32 can include a housing assembly 46 having a flow passage 26 extending longitudinally through the housing assembly 46. An outer diameter D of the housing assembly 46 is eccentric relative to the flow passage 26.

The housing assembly 46 may isolate the flow passage 26 from pressure on an exterior of the safety valve 32.

The housing assembly 46 may have at least one longitudinal recess 76 in an outer surface of the housing assembly 46.

The safety valve 32 can also include at least one line 16 extending along the recess 76. The line 16 may be selected from a group comprising at least one of an electrical line, a fluid line and an optical line.

The housing assembly 46 may have a thickened wall section 74 due to the outer diameter D being eccentric relative to the flow passage 26. At least one electrical motor 56, biasing device 70, magnet 48 and/or position sensor 62 may be positioned in the thickened wall section 74.

The electrical motor 56 can displace a magnet 48 against a biasing force exerted by a biasing device 70, with each of the electrical motor 56, magnet 48 and biasing device 70 being positioned in the thickened wall section 74.

Also described by the above disclosure is a well tool 20 which can include a magnetic coupling 52 between first and second magnet devices 40, 44. The second magnet device 44 can include a series of magnets 48 which are unequally spaced circumferentially about the first magnet device 40.

A circumferential spacing s between the magnets 48 may be less than another circumferential spacing S1 between the magnets 48. At least one biasing device 70 can be positioned in the second circumferential spacing S1 between the magnets 48.

A circumferential spacing s between the magnets 48 may be less than another circumferential spacing S2 between the magnets 48. At least one line 64 can be positioned in the second circumferential spacing S2 between the magnets 48.

The well tool 20 can also include a housing assembly 46 having a flow passage 26 extending longitudinally through the housing assembly 46. An outer diameter D of the housing assembly 46 may be eccentric relative to the flow passage 26.

A safety valve 32 described above can include a longitudinally extending flow passage 26, a closure device 24 which selectively permits and prevents flow through the flow passage 26, and an outer diameter D which is eccentric relative to the flow passage 26.

The safety valve 32 may also include at least one longitudinal recess 76 in an outer surface of the safety valve 32. At least one line 16 can extend along the recess 76.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

In the above description of the representative examples of the disclosure, directional terms, such as "above," "below," "upper," "lower," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A safety valve for use in a subterranean well, the safety valve comprising:

a housing assembly having a flow passage extending longitudinally through the housing assembly; and wherein an outer diameter of the housing assembly is eccentric relative to the flow passage, wherein the housing assembly has a thickened wall section due to the outer diameter being eccentric relative to the flow passage, and wherein at least one position sensor is positioned in the thickened wall section.

2. The safety valve of claim 1, wherein the housing assembly isolates the flow passage from pressure on an exterior of the safety valve.

3. The safety valve of claim 1, wherein the housing assembly has at least one longitudinal recess in an outer surface of the housing assembly.

4. The safety valve of claim 3, further comprising at least one line extending along the recess.

5. The safety valve of claim 4, wherein the line is selected from a group comprising at least one of an electrical line, a fluid line and an optical line.

6. The safety valve of claim 1, wherein at least one electrical actuator is positioned in the thickened wall section.

7. The safety valve of claim 1, wherein at least one biasing device is positioned in the thickened wall section.

8. The safety valve of claim 1, wherein at least one magnet is positioned in the thickened wall section.

9. A safety valve for use in a subterranean well, the safety valve comprising:

a housing assembly having a flow passage extending longitudinally through the housing assembly; and wherein an outer diameter of the housing assembly is eccentric relative to the flow passage, wherein the housing assembly has a thickened wall section due to the outer diameter being eccentric relative to the flow passage, and wherein an electrical actuator displaces a magnet against a biasing force exerted by a biasing device, each of the electrical actuator, magnet and biasing device being positioned in the thickened wall section.

10. A safety valve, comprising:

a longitudinally extending flow passage;

a closure device which selectively permits and prevents flow through the flow passage;

an outer diameter which is eccentric relative to the flow passage; and a thickened wall section due to the outer diameter being eccentric relative to the flow passage, wherein at least one magnet is positioned in the thickened wall section.

11. The safety valve of claim 10, further comprising at least one longitudinal recess in an outer surface of the safety valve.

12. The safety valve of claim 11, further comprising at least one line extending along the recess.

13. The safety valve of claim 10, wherein at least one electrical actuator is positioned in the thickened wall section.

14. The safety valve of claim 10, wherein at least one biasing device is positioned in the thickened wall section.

15. A safety valve, comprising:

a longitudinally extending flow passage;

a closure device which selectively permits and prevents flow through the flow passage;

an outer diameter which is eccentric relative to the flow passage; and a thickened wall section due to the outer diameter being eccentric relative to the flow passage, wherein an electrical actuator displaces a magnet against a biasing force exerted by a biasing device, each of the electrical actuator, magnet and biasing device being positioned in the thickened wall section.

* * * * *